US006004245A

United States Patent [19]

Boos

[11] Patent Number: 6,004,245

[45] Date of Patent: Dec. 21, 1999

[54] WEIGHTLIFTING EXERCISE DEVICE PROVIDING SELECTED BODY POSITIONS OF USE

[76] Inventor: John L. Boos, 313 Manhattan Ave., North Babylon, N.Y. 11703

[21] Appl. No.: 09/340,809

[22] Filed: Jun. 28, 1999

[51] Int. Cl.[6] ..... A63B 21/06

[52] U.S. Cl. ..... 482/93; 482/106

[58] Field of Search ..... 482/93, 94, 105–108; D21/680–682

[56] References Cited

U.S. PATENT DOCUMENTS 4,360,198 11/1982 Waulters ..... 482/106

5,679,105 10/1997 Vittone et al. ..... 482/93

*Primary Examiner*—John Mulcahy

*Attorney, Agent, or Firm*—Myron Amer P.C.

[57] ABSTRACT

A weight-supporting user-encircling frame into which the user positions him/her self preparatory to lifting the frame with weights of a selected extent mounted thereon. The frame has vertically positionable hand grips that in their positions of movement effect the extent of the knee bend in the assumed lifting position of the user, thus obviating, for example, a deep knee bend which for medical reasons the user should not assume while weight-lifting.

1 Claim, 3 Drawing Sheets

WEIGHTLIFTING EXERCISE DEVICE PROVIDING SELECTED BODY POSITIONS OF USE

The present invention relates generally to weight-lifting exercising and, more particularly, to an improved weight-lifting exercise device providing the exerciser, as is already available, with the option of deciding the amount of exercise weights to be used, and also an option, not now available, as to starting exercising positions as might be dictated for the therapeutic purposes of the exercising, all as will be better understood as the description proceeds.

EXAMPLES OF THE PRIOR ART

Exercise bars with circular bar weights at opposite ends are already well know, as exemplified by U.S. Pat. No. 4,749,188 issued to Montgomery for Safety Weight Bar Assembly on Jun.7, 1988, and U.S. Pat. No. 4,890,831, issued to Craig for Barbell Exercising Device on Jan. 2, 1990, to mention but a few. It is known from common experience that the circular bar weights have to be lifted from a support floor or from a weight-support stand by an exerciser in an assumed starting position, typically referred to as a "squat" position, in which position the exerciser grips the exercise bar and exerts the necessary effort to lift the weights.

It is also known from common experience that weight-lifting exercising is often prescribed as therapy for recovery from injuries. Thus, typically, an exerciser might require therapy for a prior knee injury and to this end is restricted in the range of knee bends to a specified extent, such as, for example, twenty degrees. The squat position assumed in using the '188 and '831 exercise devices, and all other known devices, is proper for therapy by happenstance, and thus the exercise devices are often lifted, to the detriment of an exerciser, from an injury-aggravating squat position.

Broadly, it is an object of the present invention to provide a weight-lifting exercise device overcoming the foregoing and other shortcomings of the prior art.

More particularly, it is an object of the present invention to provide for making adjustments in an exercise device to obtain a range of angles in the knees and/or in the upper torso lean forward from the waist of a user, to achieve therapy requirements in the starting squat position, and achieving other benefits, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims FIG. 1 is a front elevational view illustrating one assumed position of a user of an exercise device according to the present invention;

Figure 1:
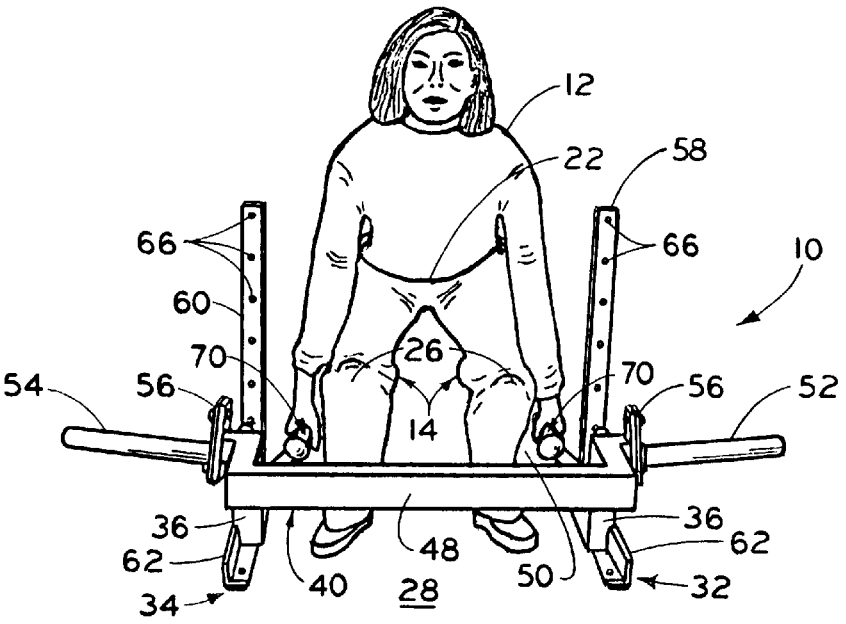
Figure 2:
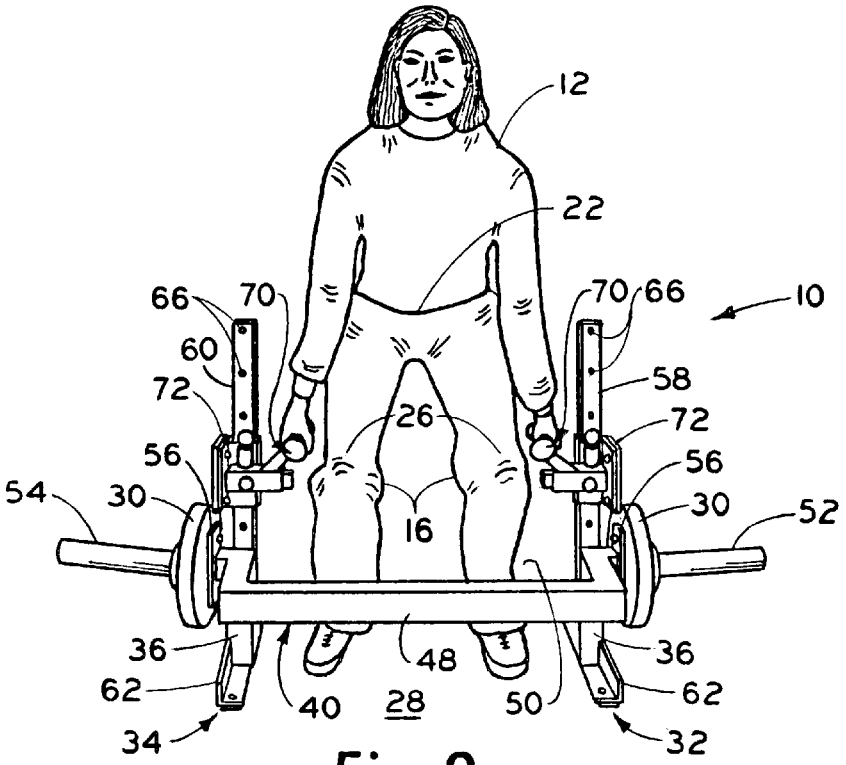
FIG. 2 is an elevational view similar to FIG. 1, but illustrating another assumed position of a user.
Figure 3:
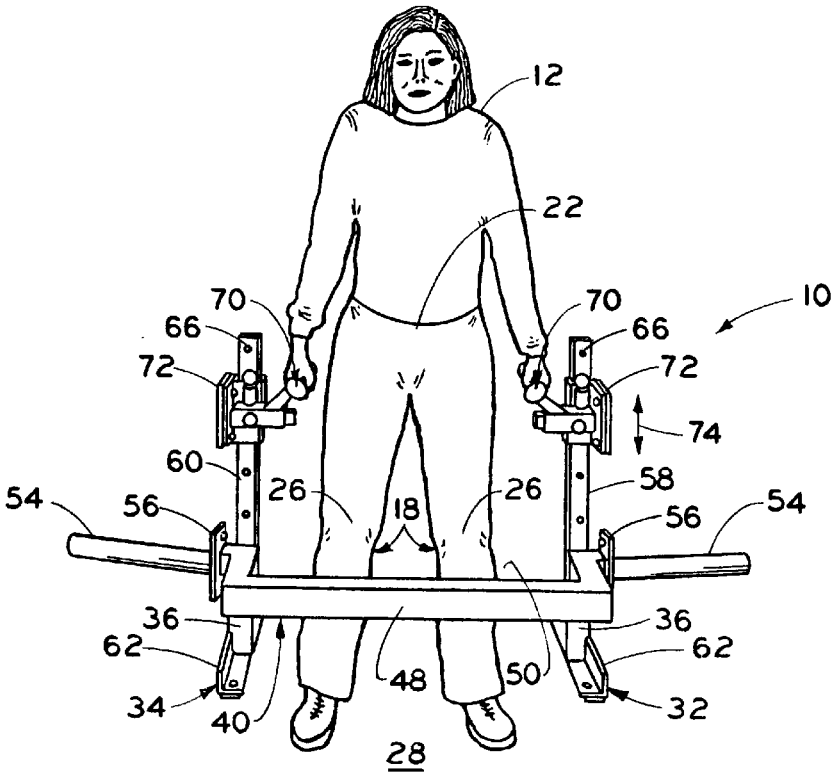
FIG. 3 is an elevational view similar to FIGS. 1 and 2, but illustrating still another assumed position of a user.
Figure 4:
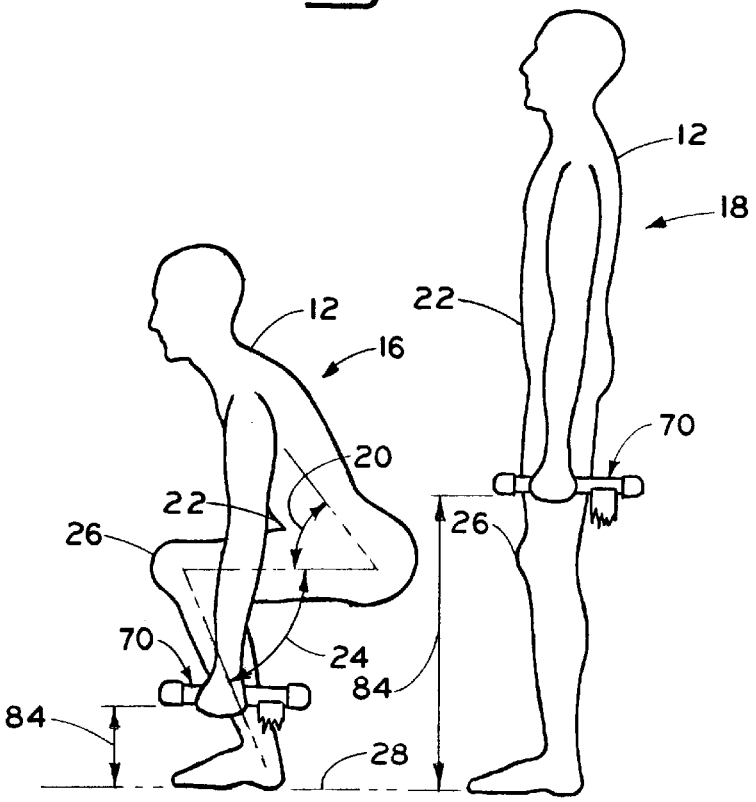
FIG. 4 is a diagramatic view illustrating anatomical relationships of the assumed positions of FIGS. 2 and 3.

Shown in FIGS. 1, 2 and 3, is an exercise device, generally designated 10, in the use of which adjustments can be made, as will be subsequently described in detail, so that a weightlifting exercise routine can be commenced with a user 12 in a deep crouch position, designated 14 in FIG. 1, or in a moderate crouch position, designated 16 in FIG. 2, or in a nominal crouch position, designated 18 in FIG. 3, or other crouch positions at the option of the user 12. The significance of these assumed positions is best understood from FIG. 4 in which the FIG. 2 and FIG. 3 positions 16 and 18 are illustrated in side-by-side comparisons demonstrating that in assuming in the FIG. 2 position 16 anatomically requires a significant upper torso angle 20 at the user's waist 22 and a correspondingly significant angle 24 at the user's knees 26. In contrast, there is almost no angle at the waist and knee locations 22 and 26 in the FIG. 3 position 18.

Underlying the present invention is the recognition that weightlifting exercise devices, such as device 10, are typically used for therapeutic treatment of injuries, such as an injured knee, and that to this end the exercise device 10 is of course required to be lifted from a support floor 28 and that the user 12 getting into the proper position for this lifting may correspondingly be required to assume a squat position that is not recommended for therapeutic purposes for injuries for which the user is exercising. The device 10 addresses this problem by allowing adjustments to be made which provide a wide range of lifting positions, as exemplified by positions 14, 16 and 18, which obviates undesirable anatomical positions assumed by the user 12.

Figure 5:
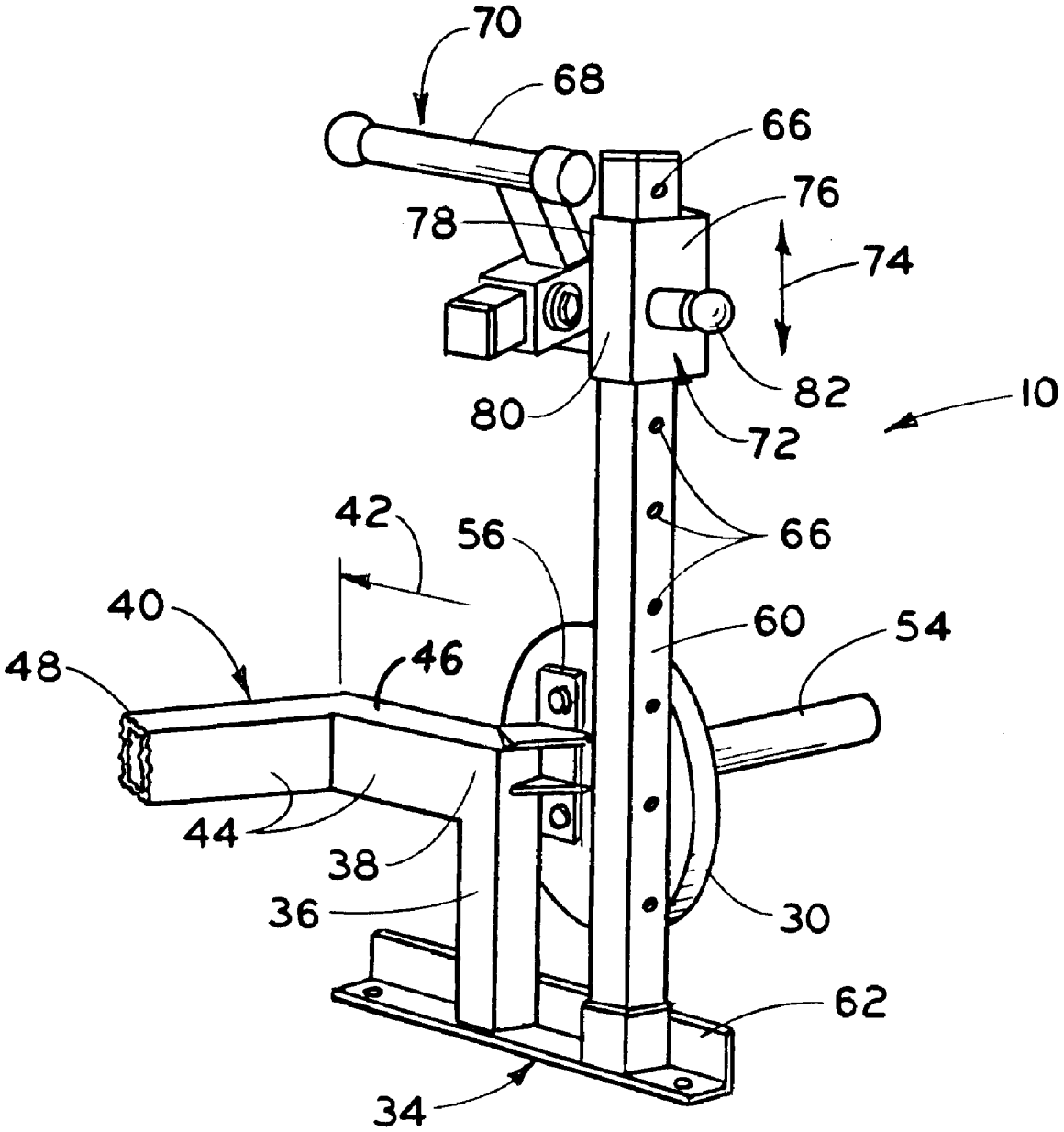
FIG. 5 is an isolated perspective view of a right side of the exercise device, of which the left side is substantially a duplicate.

As best understood from FIG. 5 in conjunction with the FIGS. 1, 2 and 3 front views, the exercise device 10 is adapted to be used to lift from a floor position 28 a selected number of weight discs, in this case only two with one on each side, as at 30. Device 10 is supported on the floor 28 on a pair of spaced apart inverted T-shaped left and right supports 32 and 34, each including an upstanding leg 36 with an upper end 38. A three-sided frame, generally designated 40, is mounted by welding or other appropriate means, to extend in cantilever relation, denoted as 42, on the upper ends 38 so as to delineate an exercising location, denoted at 44, bounded by the opposite sides 46 and front 48 of frame 40. Access to the exercising location or station 44 is through a rear opening 50 bounded between the frame sides.

The previous noted disc weights 30 are disposed on bar 52 and bar 54 mounted to extend in opposite directions from brackets 56 in turn mounted to the upper ends 38 of the supports 32, 34.

Device 10 is constructed with a pair of spaced apart left and right uprights 58 and 60, of which the right side upright 60 is shown in FIG. 5 as seen from the perspective of a user 12 from the exercising station 44 within the confines of the frame 40 each upright being welded or otherwise appropriately connected to a support leg 62 immediately rearwardly adjacent the support leg 36. Each upright 32, 34 has a vertical array of spaced apart pin-receiving openings, individually and collectively designated 66. Hand grips, generally designated 68, each including a gripping handle 70 and an integral slide 72 sized and shaped to slide vertically in opposite directions 74 along a cooperating sized and shaped upright 58, 60, in this case the shape being rectangular, are mounted for sliding or tracking movement along the uprights 58, 60. Each slide 72 has, in front and rear sides 76, 78, aligned openings 80 so that in use a so-called popper pin 82 can be inserted through aligned openings 80 at a selected sliding position of movement of the slides 72, and thus of the handles 70, establishing a distance 84 denoted in FIG. 4 and FIGS. 2 and 3, above the starting floor position 28.

From the foregoing it should be readily understood that not only does the exercise device 10 enable a safer release after an exercising routine by its contact with the floor 28 being made the horizontal legs 62 of the support 32, 34, but also that the selected heights established for the gripping handles 70 dictate the knee and upper torso angles 20 and 24 to be assumed by a user 12 preparatory to use of the exercise device 10, and that this option enables the user 12 to exercise from a desired anatomically proper starting position.

For completeness sake, it is noted that in a preferred embodiment device 10 without weights 30 is sixty pounds of metal construction material which is allowed for in adding the weights 30.

While the apparatus for herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An exercise device to be used with preferred assumed positions of an exerciser comprising a pair of spaced apart inverted T-shaped supports each presenting upstanding legs with upper ends, a three-sided frame mounted to said support upper ends to extend in cantilever relation therefrom so as to delineate an exercising location having a rear opening for obtaining access to said exercising location, disc weight-supporting bars mounted to said support upper ends to extend laterally in opposite directions therefrom, selected disc weights disposed on said bars, a pair of spaced apart uprights each mounted to said supports to extend vertically and in a clearance position rearwardly of said support upstanding legs, a vertical array of pin-receiving openings in each said upright, and a pair of hand grips extending into said frame-delineated exercising location each attached at a selected elevation to each upright with pins disposed in a cooperating pin-receiving opening, whereby said selected elevation of said hand grips dictates a knee and upper torso angle to be assumed by an exerciser preparatory to use of the exercise device.

* * * * *